US011565981B2

(12) United States Patent
Cechanski

(10) Patent No.: US 11,565,981 B2
(45) Date of Patent: Jan. 31, 2023

(54) WATER-BASED EXPLOSIVE

(71) Applicant: STT-SURFEX TECHNOLOGY & TRADING PTY LTD, Sydney (AU)

(72) Inventor: Michael Cechanski, Manly (AU)

(73) Assignee: STT-SURFEX TECHNOLOGY & TRADING PTY LTD, Sydney (AU)

( * ) Notice: Subject to any disclaimer, the term of this patent is extended or adjusted under 35 U.S.C. 154(b) by 0 days.

(21) Appl. No.: 17/311,940

(22) PCT Filed: Dec. 11, 2019

(86) PCT No.: PCT/AU2019/051362
§ 371 (c)(1),
(2) Date: Jun. 8, 2021

(87) PCT Pub. No.: WO2020/118367
PCT Pub. Date: Jun. 18, 2020

(65) Prior Publication Data

US 2022/0041524 A1 Feb. 10, 2022

(30) Foreign Application Priority Data

Dec. 11, 2018 (AU) ..... 2018904707

(51) Int. Cl.
*C06B 47/14* (2006.01)
*C06B 21/00* (2006.01)

(52) U.S. Cl.
CPC ..... *C06B 47/14* (2013.01); *C06B 21/0008* (2013.01); *C06B 47/145* (2013.01)

(58) Field of Classification Search
None
See application file for complete search history.

(56) References Cited

U.S. PATENT DOCUMENTS 4,756,776 A 7/1988 Halliday et al.
6,027,588 A 2/2000 Vattipalli et al.
(Continued)

FOREIGN PATENT DOCUMENTS

AU 614554 B 6/1989
CA 2163682 A1 5/1997
(Continued)

OTHER PUBLICATIONS

Written Opinion of the International Searching Authority in PCT/AU2019/051362; dated Mar. 4, 2020, 5 pages.
(Continued)

*Primary Examiner* — Aileen B Felton
(74) *Attorney, Agent, or Firm* — Dilworth IP LLC

(57) ABSTRACT

An explosive, in particular a water-in-oil emulsion explosive, comprising a water-based explosive composition and a gas, wherein the gas is infused with two different ranges of sizes of nanobubbles, to provide controlled hotspots for detonation to improve emulsion stability and detonation sensitivity. Into the Nano Bubble tank (31) are fed the pressurised gas in water through valve (26) and also a sample is fed into the Nano Bubble tank (31). This then provides the NanoBubble Input NBIbp1 to be fed by NB Feed Pump (33) into static mixer (51). Also fed to the Static Mixer (51) by matrix pump (41) is the explosives containing PIBSA (Poly-Iso-Butylene Succinic Anhydride) in emulsion form as Emulsion Input EInp1 from Emulsion Matrix truck. The static mixer allows for the gas to be infused into the water-based explosive composition in at least a substantial part in the form of nanobubbles (NB) which then forms a controlled explosive output for use in the blast hole (61) by the bubbles acting as a sensitiser as so called "hot spots" which transfer the energy throughout the explosive charge once initiated. This allows the thermal "hot spot" detonation
(Continued)

wave to travel through and carries the explosive to a full and controlled detonation.

12 Claims, 8 Drawing Sheets

(56) References Cited

U.S. PATENT DOCUMENTS

| | | | | |
|---|---|---|---|---|
| 10,494,312 | B2 * | 12/2019 | Senules | C06B 23/00 |
| 2009/0188245 | A1 * | 7/2009 | Merry | F01N 13/102 60/299 |
| 2011/0132505 | A1 | 6/2011 | Dlugogorski et al. | |
| 2018/0215644 | A1 * | 8/2018 | Doering | C03C 11/002 |

FOREIGN PATENT DOCUMENTS

| | | | |
|---|---|---|---|
| EP | 0161821 | B1 | 2/1989 |
| GB | 2200626 | A | 8/1988 |
| WO | 2009/045723 | A1 | 4/2009 |
| WO | 2016/010783 | A1 | 1/2016 |

OTHER PUBLICATIONS

PCT International Search Report in PCT/AU2019/051362; dated Mar. 4, 2020, 6 pages.

Rao V.M. and Ghosh P.K. "Void Size Measurement in Emulsion Explosives: A Noninvasive Approach Using NMR Imaging" Langmuir (2000) 16: 2985-2986.

* cited by examiner burning
front

Included Files mini-N2-10p-170629-1d-00
mini-N2-10p-170629-1d-01
mini-N2-10p-170629-1d-02
mini-N2-10p-170629-1d-03
mini-N2-10p-170629-1d-04

Details

| | |
|---|---|
| NTA Version: | NTA 3.0 0068 |
| Script Used: | SOP Standard Measurement 12:52:05PM 30JUN2017.txt |
| Time Captured: | 12:52:05 3/06/2017 |
| Operator: | IDEC |
| Pre-treatment: | |
| Sample Name: | Water |
| Diluent: | |
| Remarks: | |

Capture Settings

| | |
|---|---|
| Camera Type: | SCMOS |
| Camera Level: | 15 |
| Slider Shutter: | 1200 |
| Slider Gain: | 500 |
| FPS | 25.0 |
| Number of Frames: | 1498 |
| Temperature: | 27.7 °C |
| Viscosity: | (Water) 0.835 – 0.837 oP |
| Dilution factor: | Dilution not recorded |

Analysis Settings

| | |
|---|---|
| Detect Threshold: | 5 |
| Blur Size: | Auto |
| Max Jump Distance: | Auto 12.6 – 20.9 px |

Results

Stats: Merged Data

| | |
|---|---|
| Mean: | 96.0 nm |
| Mode: | 48.5 nm |
| SD: | 45.6 nm |
| D10: | 47.8 nm |
| D50: | 84.1 nm |
| D90: | 174.6 nm |

Stats: Mean +/- Standard Error

| | |
|---|---|
| Mean: | 91.4 +/- 8.4 nm |
| Mode: | 62.6 +/- 7.4 nm |
| SD: | 38.6 +/- 5.1 nm |
| D10: | 51.7 +/- 4.9 nm |
| D50: | 79.5 +/- 16.4 nm |
| D90: | 149.9 +/- 16.4 nm |
| Concentration: | 1.99e+008 +/- 3.11e+007 particles/ml |
| | 10.1 +/- 1.6 particles/frame |
| | 16.4 +/- 2.8 centres/frame |

FIGURE 4

*Gas injection from a pressurized source*

*Atmospheric air injection*

WATER-BASED EXPLOSIVE

FIELD OF THE INVENTION

The present invention relates to water-based explosives and particularly emulsion explosives and more particularly to an improved water in oil emulsion explosive that uses PIBSA (Polyisobutylene Succinic Anhydride).

The invention has been developed primarily for use in/with explosives for the mining industry and will be described hereinafter with reference to this application. However, it will be appreciated that the invention is not limited to this particular field of use.

BACKGROUND OF THE INVENTION

Water-in-oil emulsions are well known and widely accepted in the explosives industry. These types of explosives are generally understood to include explosive compositions comprised of multiple, immiscible liquids.

It is further known that emulsion explosive performance may be enhanced by the addition of a gaseous phase of voids/bubbles, preferably spherical in shape, to facilitate detonation. Referring to FIG. 1 it can be seen that normal bubbles such as used in prior art gassing techniques are of the order of millimetres.

As shown in FIG. 2 the use of gaseous phase of voids/bubbles is such that during detonation, a shock wave travels through the explosive charge which compresses the voids/bubbles contained therein. When the void/bubble rapidly compresses to higher pressures, a large amount of heat is generated. The heat created by compressing and collapsing a void/bubble can generate sufficient temperatures to cause the subsequent detonation of the surrounding explosive.

Voids/bubbles used in emulsion explosives are commonly comprised of nitrogen ($N_2$), oxygen ($O_2$), or a mixture including both. The effectiveness and control of detonation is limited using bubbles in this category.

Voids/bubbles are generally added to emulsions by various methods such as by cavitation, the addition of pre-manufactured closed celled micro-spheres, or chemical gassing. In recent years, chemical gassing has become the preferred method because of its low cost, excellent dispersion, and ease of storage and transport.

However chemical gassing has its limitations as will be detailed.

Nowadays, the PIBSA (Polyisobutylene Succinic Anhydride) based emulsifiers used for the emulsion preparation and stabilisation the emulsion explosives are stable and safer to manufacture, transport, re-pump, load and use in the all kind of blasting and mining applications. PIBSA based emulsifiers are, however, more expensive, when compared with the SMO (Sorbitan Mono Oleate) or other conventional water-in-oil emulsifier-based systems.

Therefore, there is a need to provide greater effectiveness without greater use of PIBSA and preferably with using less.

Also, the droplets of these emulsions comprise a super-cooled aqueous solution of ammonium nitrate salt (AN) dispersed in an oil based dispersant solution, which results in a thermodynamically unstable system. Hence, the system ages with time, resulting in changes to the rheological properties, the phase composition and consequently the blasting performance.

Instability in the explosives field is always a problem that needs options to make improvements.

The pumpability of liquid viscous bulk explosives is well researched and described in the prior art. The instability of these emulsions is related to the crystallisation of the ammonium nitrate (AN) solution inside the emulsion droplets. The crystallisation processes of emulsions of super-cooled salts are kinetically slow and can take up to a number of weeks to a few months. However, it has been found that small nucleation sites within the system can cause the emulsion to change and start crystallising.

The instability of the emulsion results in droplets rupturing, which in some cases can initiate further nucleation and crystallisation of adjacent droplets. The emulsion droplets usually contain a range of surfactants, like PIBSA based emulsifiers that stabilise these colloidal two-phase systems by preventing contact between the dispersed droplets.

The emulsion stability, generally speaking, depends on the properties of the interfacial layer that forms between two immiscible phases, and the interfacial properties are influenced by surfactant type and behaviour at the surfactant interactions with the AN solution.

It is known that EE (Emulsion Explosives) sensitivity and performance depend on the gaseous bubbles or gas occluded solids in form of closed or partly closed microspheres admixed into emulsion.

The most common method for producing those "hot spots" and regulating/controlling the emulsion density is the chemical gassing in which the gassing agent reacts with ammonium ion ($NH_4^+$) of the super cooled AN solution producing gas bubbles of nitrogen.

During the gassing process the stability of emulsion is being disturbed due to the rupture of the continuous oil/emulsifier layer surrounding the droplets of super-cooled AN solution droplets. Some nucleation (crystallisation) is a direct result of that gassing reaction and the rate of that nucleation would depend on a number of factors (formulation, ratio of the various components, type of nitrate salts, water content, emulsifier type and % content, temperature cycling, mechanical stresses and other factors). Consequently, the stability and the shelf life/sleeping time in the blast hole gets shorter and that change affects the blasting performance in a negative way.

Usually, to prevent the instability caused by chemical gassing, a higher content of expensive PIBSA/other emulsifier combinations is used in the EE formulations.

It can be seen that known prior art emulsion explosives have the problems of:

a) The initial high cost of PIBSA b) Need to improve sensitivity and performance c) Need to control thermodynamic stability d) A need to form hot spots without chemical gassing e) While limiting the need for a higher content of expensive PIBSA The present invention seeks to provide an improved emulsion explosive, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention, a water-in-oil emulsion explosive is provided by an explosive comprising a water-based explosive composition, and a gas, wherein the gas is infused to the water-based explosive composition in the form of nanobubbles (NB), or nanobubbles (NB) and microbubbles (MB) at a predefined ratio.

It can be seen that the invention of a water-in-oil emulsion explosive provides the benefit of the emulsion explosives (EE) is that the bubbles are used as a sensitiser so called "hot spots" which transfer the energy throughout the explosive charge once initiated. This allows the thermal "hot spot" detonation wave to travel through and carries the explosive to a full and controlled detonation.

Preferably the gas is a combination of one or more of:

a) air
b) oxygen
c) $CO_2$
d) Nitrogen
e) Hydrogen.

The water-based explosive can be a water-based gel explosive or a water-in-oil emulsion explosive. Preferably the water-in-oil emulsion explosive is PIBSA (Poly-Iso-Butylene Succinic Anhydride).

The gas can be infused with two different ranges of sizes of nanobubbles.

Preferably the first range of sizes of nanobubble is 50-100 nm and the second range of sizes of nanobubble is 100-700 nm Preferably gas is infused with two different ranges of sizes of nanobubbles in a ratio of substantially 1:1.

According to one aspect, the present invention provides an explosive composition including gas NB/MB to stabilise the water-in-oil emulsions based on PIBSA derivatives.

This is a cost-effective way to stabilise the water-in-oil emulsions based on PIBSA derivatives (amines/imides) compared to other water-in-oil emulsifiers, such as type SMO (Sorbitan Mono Oleate)

According to a further aspect of this invention there is provided an explosive composition including NB/MB which serve as both stable and effective "hot spots" to carry through efficient initiation and detonation process of blasting operations.

This is an efficient, cost-effective and practical replacement of the currently used gassing systems or the systems based on expensive strong wall glass or plastic microspheres.

It can be seen that this invention allows to formulate emulsion explosives with a lower content of PIBSA with maintained stability and with a significant number of improved and important performance characteristics.

In preferred forms, the invention provides a water-in-oil emulsion explosive comprising: a. an emulsion phase having: a discontinuous aqueous phase comprising discrete droplets of an aqueous solution of inorganic O2 releasing salts, a continuous water-immiscible organic phase throughout which the droplets are dispersed, an emulsifier having low content PIBSA, which forms an emulsion of the droplets throughout the continuous organic phase, a combined emulsion stabiliser and explosive sensitiser comprising a distribution of liquid saturated nanobubbles (NB) and microbubbles (MB) of a gas, the nanobubbles and microbubbles being distributed throughout the emulsion phase, and wherein the bubbles are formed from a gas or combination of gases selected from air, $O_2$, $CO_2$, $N_2$, $H_2$; wherein the nanobubbles and microbubbles are injected into the emulsion phase to form a distribution of nanobubbles and microbubbles therein for improving emulsion stability and detonation sensitivity.

The invention also in one form provides a method of preparing a water-in-oil emulsion explosive comprising:

a) providing nano and micro bubbles of any one or more of air, $O_2$, $CO_2$, $N_2$, $H_2$ by means of NB/MB generators, and
b) injecting the gas bubbles into the emulsion phase (matrix) in a highly saturated liquid form by injection means to form a distribution of the nano and micro bubbles throughout the emulsion matrix.

The invention is a novel application (in water-based explosives) of creating gas voids (detonation carrying "hot spots"). The Nano bubbles are inert, stable and of uniform size distribution creating huge reactive surface area which increases the contact between the oxidiser and fuel phases which benefits the performance of the final product. NB contribute to the overall stability of the final product (emulsion/water gel)

This combination of NB in water-based explosives leads to superior performance compared to available technology and the currently available tools of chemical gassing The NB can be directly introduced to either water phase carrier or fuel phase carrier of the emulsion matrix or directly to the pumpable matrix itself. The choice depends on the technique preferences and costing of the engineering set up.

NB reduces the density of carrier liquid/emulsion and therefore the pumping friction will be reduced NB generator is a tool for introduction of "hot spots" in a controlled way and at controlled degree of saturation and nm size). The process is based on physical stable bubble creation process and mixing those at the right spot (preferably static mixer at the end of the delivery hose)

The invention also provides a method of preparing a water-in-oil emulsion explosive comprising:

a) Determining a required explosive
b) providing of nano and micro bubbles of any one or more of air, $O_2$, $CO_2$, $N_2$, $H_2$ by means of NB/MB generators;
c) providing an emulsion phase (matrix) of explosive;
d) injecting the gas bubbles into the emulsion phase (matrix) in a highly saturated liquid form by injection means to form a distribution of the nano and micro bubbles throughout the emulsion matrix
e) controlling the distribution of nanobubbles and microbubbles therein for providing controlled hotspots for detonation and improving emulsion stability and detonation sensitivity.

The gas can be infused with two different ranges of sizes of nanobubbles.

The emulsion phase (matrix) of explosive contains PIBSA (Poly-Iso-Butylene Succinic Anhydride).

Preferably the method includes a further step of monitoring the required explosive and stops or alters the providing of nano and micro bubbles or stops or alters the injecting the gas bubbles into the emulsion phase.

This invention/technological novelty includes in one form the case of at least bringing one or more of the benefits of:

Stability of emulsion explosives allowing for cost optimisation

Sensitisation with define, very small size evenly distributed Nano/Micro bubbles—twofold task for NB/MB produced through NB/MB generators: stabilization of emulsion (NB-50-1000 nm/MB (1-1000 microns) and hot spot sensitization Improvement of detonation process by introduction of NB/MB bubbles Stability, shelf-life and extended sleeping time much improved due to the NB/MB longevity Improvement of overall blasting performance due to the efficiency of chemical reactions based on the much larger contact area between the oxidiser and the fuel phase of emulsion or other water-based explosives (water gel and slurries)

When generated, small bubbles can be created at higher concentrations than larger bubbles. The surface area of a volume of bubbles is in inverse proportion to the bubble diameter; thus 1 ml of 100 nm diameter bubbles (2×10e15 bubbles) has 1000 times more surface (240 sqm) than 1 ml of 0.1 mm bubbles (2×10e6 bubbles, 0.24 sqm)

The detonics (VOD/detonation pressure/detonation temperature/detonation efficiency) of water based explosives can be positively influenced by the pressure inside the bubble in water, e.g.: diameter 1 mm atm; 1 micron>3.9 atm; 500 nm>5.8 atm; 100 nm>25 atm On average higher bubble pressures inside the explosive column of filled borehole will facilitate a detonation process with higher thermal energy hot spots and therefore bringing the whole detonation process closer to an ideal detonation; the process of creating NB/MB is separate from the process of handling the emulsion and the introduction of NB/MB takes place at the end of the charging hose where the mixing of NB/MB is happening Improvement of water-ring (may contain NB/MB as well) which facilitates the emulsion transport and pumping with less friction when pumping the emulsion Fine bubbles have an electrically charged surface and in water they are negatively charged which with the large specific surface area and charged surface enables NB/MB to effectively absorb opposite charged molecules/particles which improves the stability of the emulsion/colloid system The gas pressure inside the NB/MB is higher than in large bubbles, therefore the surface tension of a small bubble is higher as well Small bubbles coalescence less than larger bubbles and by keeping their spherical form they contribute to the more complete heat development and heat transfer during the detonation process Preferably in at least one aspect of the present invention to provide an explosive composition incorporating gaseous (air/$CO_2$/$N_2$/$H_2$/$O_2$) NB at different size ranges (50-100 nm/100-700 nm) or NB/MB at 50/50 ratios depending on the type of NB generator being applied.

The introduced NB due to their nm size and created large surface area as well as NB's inert character provide additional stabilisation effect to the emulsion formulated with optimised and lower content of costly PIBSA-based polymeric emulsifiers.

NB when generated, either in water or hydrophobic fuel carrier (Diesel Fuel Oil—DFO, Mineral Oil—MO) can yield much higher concentration/volume than larger bubbles.

The surface area of a volume of bubbles is in inverse proportion to the bubble diameter; thus 1 ml of 100 nm diameter bubbles (2×10e15 bubbles) has 1000 times more surface area (240 square metres) than 1 ml of 0.1 mm bubbles (2×10e6 bubbles, 0.24 sq·m)

The gas pressure inside the NB is higher than in large bubbles and NB coalescence less than larger bubbles. NB are less compressible and by keeping their spherical form they may contribute to the more complete heat development and transfer during the detonation process as well as sustain the higher hydrostatic head pressure in deep blast holes.

The more efficient blasting process performance brings also a reduction in NOx development It is a further aspect of at least one aspect of this invention to provide an improvement of "water ring" technique containing water or ammonium nitrate/other nitrates water solution and saturated with NB/NB-MB which would facilitate the emulsion transport and pumping with a lower friction and at low pumping pressures.

According to this invention there are provided emulsion formulations and processing methods of making an improved and cost-effective water-in-oil emulsion explosive (Note: water based gel explosives to be covered in the claims as well) by incorporating gas (air/oxygen/$CO_2$/nitrogen/hydrogen) Nano bubbles (NB by definition 50-1000 nm) and mixture of NB at a certain ratio/percentage of Micro bubbles (MB—by definition >1000 nm=1 microm)

It was found that NB or NB/MB blend contribute to improved emulsion stability allowing for cost efficient optimisation of PIBSA and other emulsifiers' contents. NBs serve as density control and sensitivity agent and consequently providing an improved emulsion and blasting performance.

NBs and NB/MB admixture serve as a substitute for the gas bubbles provided by the current technology of chemical gassing and mechanical air admixture.

The air/gas NB and NB/MB were generated in two commercially available NB and MB generators as well as with STT prototype (Surfex Technology & Trading) NB generating set up.

The respective NB were introduced to the emulsion Matrix as a highly saturated and concentrated NB or NB/MB in water solution or in additional set of experiments as air NB saturated Mineral Oil/DFO solution.

Three types of generators have been used and the detailed description is provided in the Table 1.

The saturated NB water or oil carrier (a low viscosity water-in-oil emulsion carrier can also be used) may/may not contain some specific surfactants compatible with the emulsion explosives systems. The surfactant's role is to decrease the surface tension of the water used in the process of NB generation.

The admixture of the injected stream of NB or NB/MB can be achieved either via a semi-continuous (batch wise) or a continuous in-line processes and its homogenous dispersion obtained by use of an in-line static mixers placed at a designated point between the emulsion matrix supply and the point of discharge of the final composition.

The Emulsion Explosives (EE) pumping technology uses a water ring technique to facilitate the transfers of viscous emulsion in an efficient way. According to this invention the NB saturated water ring (with or without the surfactants lowering the surface tension of water or with/without dissolved ammonium nitrate/other nitrates) reduces substantially the resistance of pumping the viscous water-in-oil emulsion and that is due to the huge surface area created by NB Other aspects of the invention are also disclosed.

BRIEF DESCRIPTION OF THE DRAWINGS

Notwithstanding any other forms which may fall within the scope of the present invention preferred embodiments of the invention will now be described, by way of example only, with reference to the accompanying drawings in which:

FIGS. 3 and 4 are a graphical representation and technical sheet of output of size distribution and concentration data for NB Generated with miniGaLF (Japanese equipment make) showing the usual output of such a generator;

DESCRIPTION OF PREFERRED EMBODIMENTS

According to this invention there are provided emulsion formulations and processing methods of making an improved and cost-effective water-in-oil emulsion explosive by incorporating gas (air/oxygen/$CO_2$/nitrogen/hydrogen) Nano (NB) and Microbubbles (MB) which substantially will contribute to emulsion stability, sensitisation, density control detonation properties and blasting performance.

The air NB/MB are generated in commercially available NB/MB generators and introduced to the emulsion Matrix as a highly saturated and concentrated NB/MB water solution. The NB/MB water carrier or water-in-oil specific emulsion carrier may/may not contain some specific surfactants compatible with the emulsion explosives systems.

The admixture of the injected stream of NB/MB can be achieved either via a batch wise or in-line processes and its homogenous dispersion obtained by use of in-line static mixers placed at a designated point between the emulsion matrix supply and the point of discharge of the final composition.

In a particular preferred form there is provided an explosive comprising a water-based explosive composition, and a gas, wherein the gas is infused to the water-based explosive composition in at least a substantial part in the form of nanobubbles (NB). The gas is a combination of one or more of air, oxygen, $CO_2$, Nitrogen, and Hydrogen.

Figure 1:
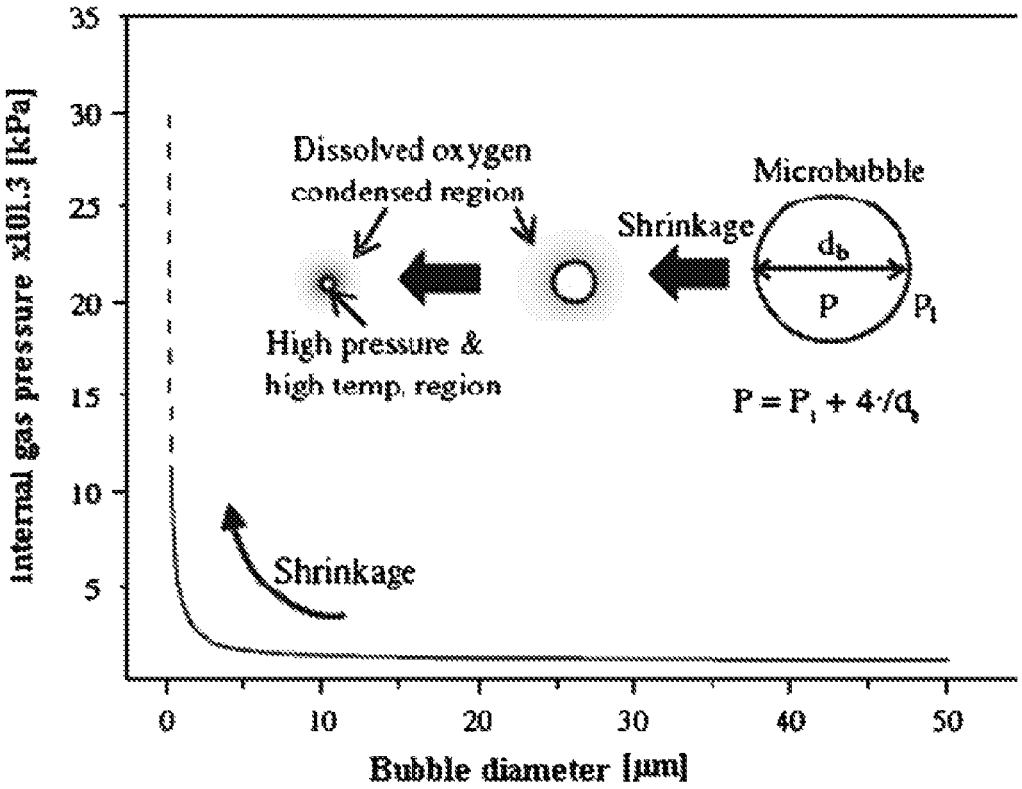
FIG. 1 is a diagrammatic view of the shrinkage or collapse of bubbles to form microbubbles MB and nanobubbles NB.
Figure 2A:
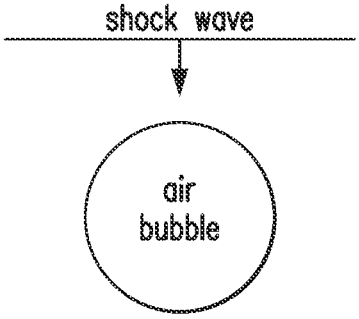
FIG. 2 is a diagrammatic view of the forced collapse of microbubbles MB and nanobubbles NB to form a burning front of a hot-spot allowing to act as a centre for the continued chemical reaction and detonation process.
Figure 2B:
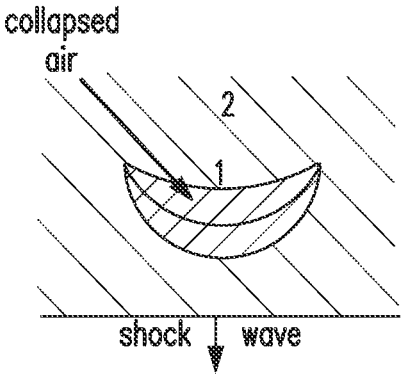
Figure 2C:
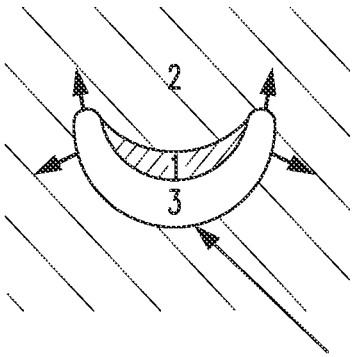
Figure 2D:
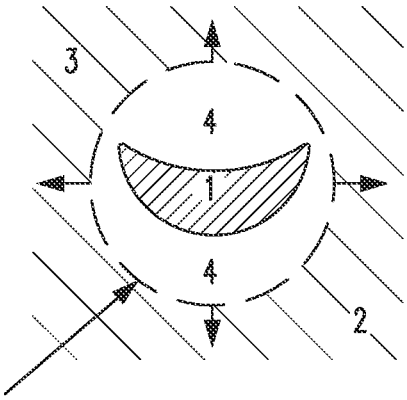

Referring to FIG. 1 it can be seen that normal bubbles such as used in prior art gassing techniques are of the order of millimetres. However by high pressure and other shrinkage techniques, there is formed micro bubbles MB (Microbubbles) of the order of 1-1000 microns and nano bubbles NB (Nanobubbles) in the order of 50-1000 nm.

Referring to FIG. 2, commercial explosives rely on the local heating of deliberately created reaction centres—"hot spots"—for functioning. By the mechanism of forced bubble collapse, by application of shock wave in a), the bubble collapses as in b) and energy is focused within a small volume of the explosive material close to and downstream of the bubble. At such a "hot spot", the material reaches a temperature in excess of the rest of the explosive and the hot spot can then react as a center for the continued chemical reaction and detonation process as in c) and d).

Example Set-Up

Figure 5:
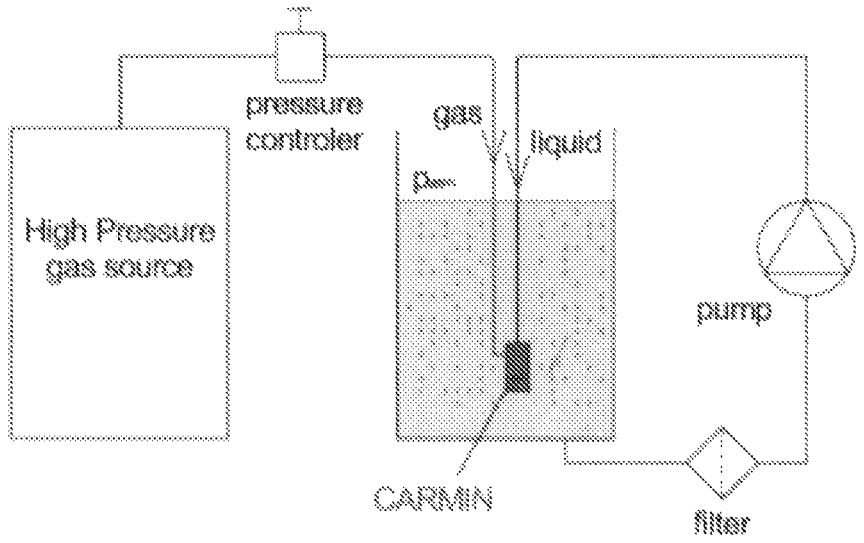
FIGS. 5 and 6 are diagrammatic set-ups showing two alternatives for MB/NB generation with FIG. 5 when using compressed $CO_2$ from high pressure bottle and FIG. 6 using atmospheric air.
Figure 6:
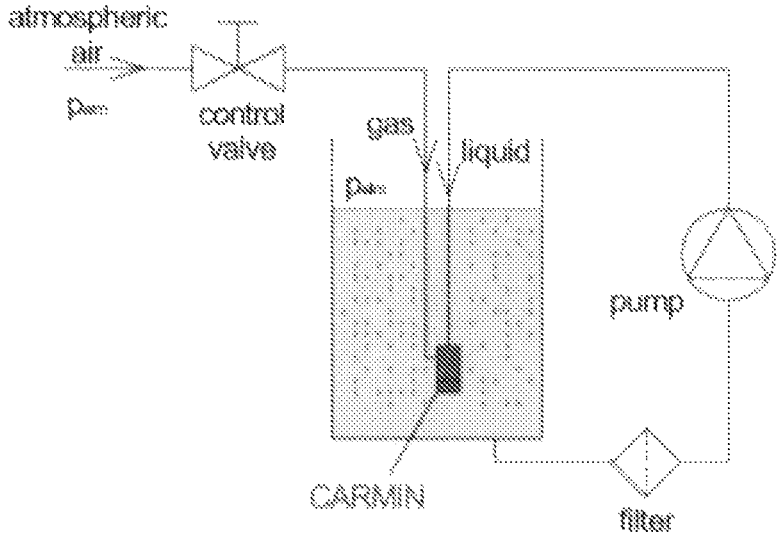

The details of a general system of the water and gas injection from a pressurised source or atmospheric injection is shown in more detail in FIGS. 5 and 6.

In FIG. 5 there is the general approach of gas source from a high-pressure gas source that through pressure controller is feed as gas into container which also has liquid pumped into it so as to create bubbles under pressure. This allows choice of gas or mixture of gases.

In FIG. 6 there is the general approach of air source from atmospheric air source that through control valve is feed as gas into container which also has liquid pumped into it so as to create bubbles under pressure.

Figure 7:
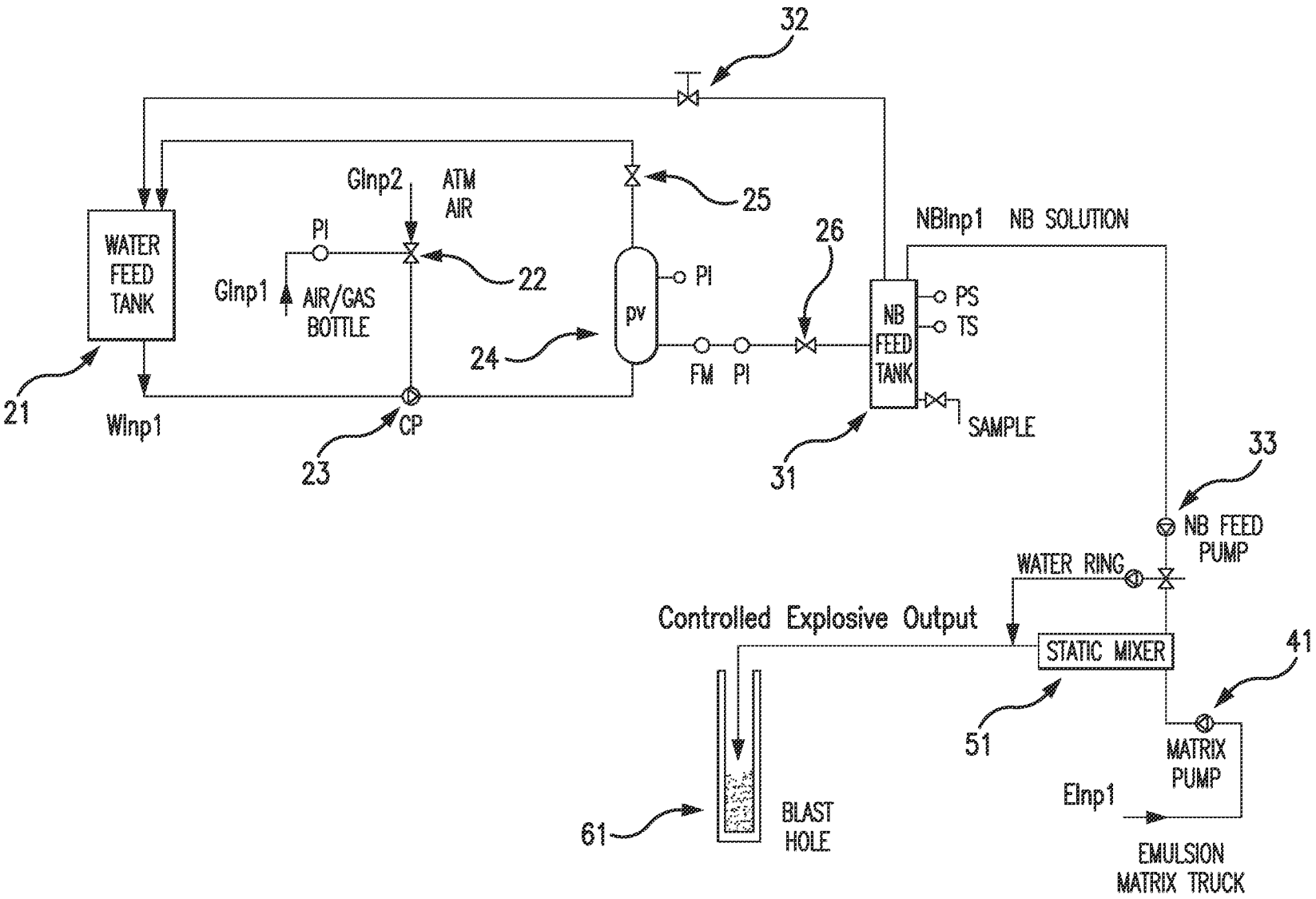
FIG. 7 is a diagrammatic view of the system of manufacturing a water-based explosive in accordance with an embodiment of the invention in accordance with an embodiment of the invention

It can be seen, referring to FIG. 7, that there is a detailed combined air source and nano and/or micro bubble generator with static mixing in ratio with explosives in emulsion to form the controlled water based explosive for use in a blast hole.

Initially shown is water feed tank 21 which provides the water input WInp1. The gas feed is provided as gas input GInp1 from a pressurised air/gas bottle or as gas input GInp2 from atmospheric air and selectively chosen or mixture fed by valve 22 to mix with water at pump CP 23 that feeds to fixed volume pressure chamber 24 so that pressure and volume of the gas water mixture can be controlled. If required valving can dispel unwanted pressure through valve 25 back to the water feed tank 21.

Into the Nano Bubble tank 31 are fed the pressurised gas in water through valve 26 and also a sample is fed into the Nano Bubble tank 31. This then provides the NanoBubble Input NBIbp1 to be fed by NB Feed Pump 33 into static mixer 51.

Also fed to the Static Mixer 51 by matrix pump 41 is the explosives containing PIBSA (Poly-Iso-Butylene Succinic Anhydride) in emulsion form as Emulsion Input EInp1 from Emulsion Matrix truck.

The static mixer allows for the gas to be infused into the water-based explosive composition in at least a substantial part in the form of nanobubbles (NB) which then forms a controlled explosive output for use in the blast hole 61 by the bubbles acting as a sensitiser as so called "hot spots" which transfer the energy throughout the explosive charge once initiated. This allows the thermal "hot spot" detonation wave to travel through and carries the explosive to a full and controlled detonation.

A water ring 52 is provided around the Static Mixer 51 for feeding NB water directly to enhance transfer of the emulsion explosive from the static mixer.

Example Equipment a) Mixer for making emulsion matrix
b) Heating plate
c) pH meter
d) Capacitance meter with capacitance probe
e) Microbubbles Generator—commercial Sarl Ylec—French make, designed to produce 10-40 micron bubbles at 6 bar water feed with atmospheric air
f) Centrifugal pump with pressure vessel and needle valve restriction (STT make) 150-200 nm bubble size with atmospheric air; hydrodynamic cavitation 3-5 bar water feed; 15-20 water passes
g) Nano bubble generator—commercial Japanese make; 40-100 nm with 2 water passes and 150-200 nm with 1 water pass; based on static mixer principle of mixing gas-liquid (water/oil)

Example Method

Figure 8:
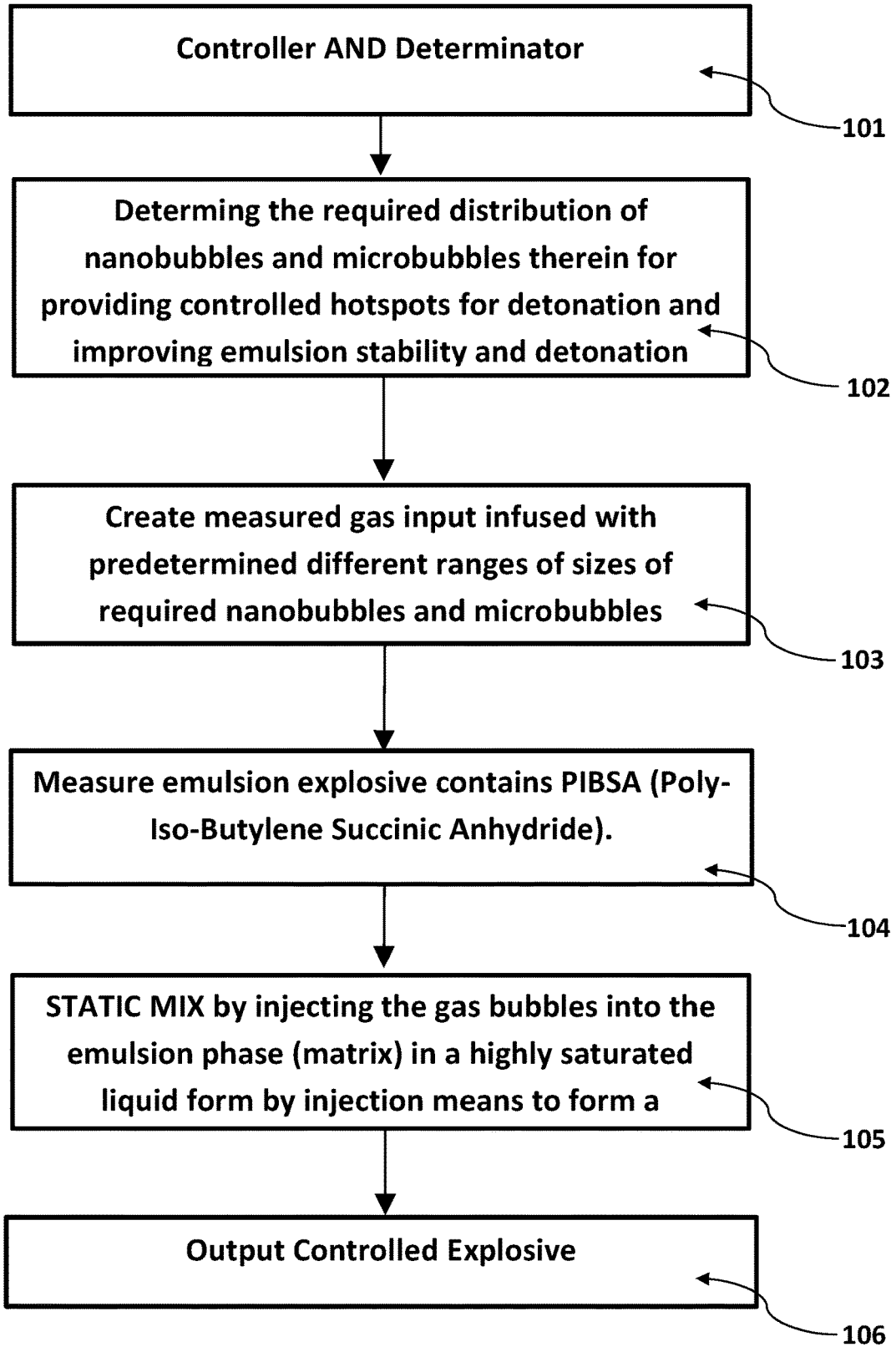
FIG. 8 is a diagrammatic flow diagram of the method steps of manufacturing a water-based explosive in accordance with an embodiment of the invention.

Referring to FIG. 8 there is a method of preparing a water-in-oil emulsion explosive comprising step 101 of providing a controller and determination for determining a required explosive. In step 102 there is reference such as to library 203 for determining the required hot spots and therefore required ratio of nano and micro bubbles.

In step 103 there is the providing of the required ratio of nano and micro bubbles of any one or more of air, $O_2$, $CO_2$, $N_2$, $H_2$ by means of NB/MB generators. From the explosive source is the step 104 of providing the required measured emulsion explosive contains PIBSA (Poly-Iso-Butylene Succinic Anhydride) in an emulsion phase (matrix) of explosive.

Figure 9:
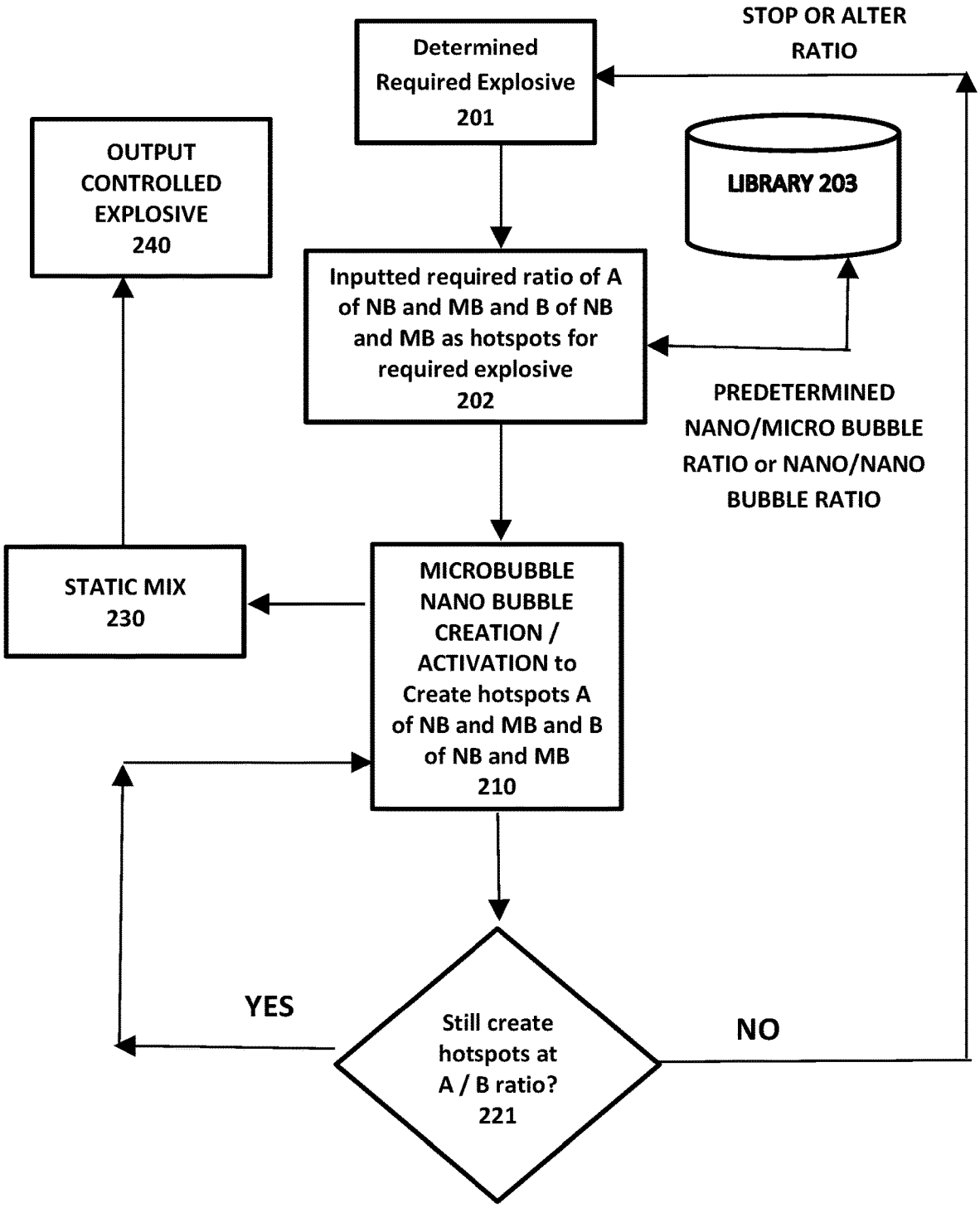
FIG. 9 is a diagrammatic view of the system of control of the method of control of operation of a water-based explosive in accordance with an embodiment of the invention.

In step 105 these two sources result in the static mix by injecting the gas bubbles into the emulsion phase (matrix) in a highly saturated liquid form by injection means to form a distribution of the nano and micro bubbles throughout the emulsion matrix. The result Example Control Referring to FIG. 9 there can be seen an example of controlling the explosion to provide a required explosion by the controlling of the distribution of nanobubbles and microbubbles therein for providing controlled hotspots for detonation and improving emulsion stability and detonation sensitivity.

In the first part of control 201 there is the determining of the required explosive and from the library 203 determining the required is the predetermined Inputted required ratio of A of NB and MB and B of NB and MB as hotspots for required explosive 202. At 210 the microbubble and nanobubble NB is created to allow activation of hotspots. The predetermined control of hotspots is thereby first provided by the nanobubbles NB and microbubbles MB in gas being infused. Preferably the control is with two different ranges of sizes of nanobubbles or a required ratio of A of NB and MB and B of NB and MB as hotspots for required explosive. Therefore the ratio of predetermined nanobubbles NB and microbubbles MB in gas being infused provides a controlling element on the explosion.

As shown at 221 there can be a further step of monitoring the required explosive and if the required explosive is on course as directed than the continuation of the creation and activation step 210 continues. However in the monitoring there needs to be a stop or alteration then this can occur by stopping the creation or activation of the nano and micro bubbles or by a stop or alteration of the injecting the gas bubbles into the emulsion phase. The determination of the new required explosive requires a return to 201.

It can be seen that the system not only provides the ability to use less it also controls hotspots for detonation and improves emulsion stability and detonation sensitivity Example Materials Oxidiser Solution Bulk (booster sensitive) formulations with 2 different concentration of technical grade AN in aqueous phase (80 and 83 w %) were used and for cap-sensitive formulations containing AN and technical grade SN (sodium nitrate) with 11 w % of water.

Fuel Solution

Bulk (booster sensitive) formulations contained technical grade of fuel oil No2 (DFO No 2) PIBSA based emulsifiers from Clariant and Lubrizol and applied at 20 w % in some formulations and 15 w % in some others; some formulations used MO (mineral oil) in place of DFO.

Sorbitan Mono Oleate (SMO) from Croda was used in 2 formulations.

Cap-sensitive formulations used blend of Paraffin and Microcrystalline wax/Mineral Oil/SMO and some PIBSA.

Nano Bubble and Micro Bubble Generation

It should be noted that there is an essential difference between NB which the present invention is based on and any prior art systems having gas bubbles introduced to the Emulsion Explosives. The prior art gas bubbles use dispersion of gas of large size in the matrix of emulsion/gel/slurry. That gas introduction is done by mechanical means or the chemical reaction between NH4+ and NO2–>N2+H2O. There is no control of the size of the air/gas entrapped in the viscous mass of the matrix. That old and known technology is based on entrapment of gas bubbles. However the present invention uses the process stage of generating controlled size NB in saturated water or oil solution prior for dispersing it into the emulsion/gel matrix. The prior art cannot effect gassing/gas entrapping technology directly into the mass of matrix and could never produce Nanosize bubbles. It is technically impossible.

Formation, growth and collapse of MBs in solution is often referred to as cavitation. Based on the mode of generation, cavitation is broadly classified into four categories, i.e. acoustic, hydrodynamic, optic and particle cavitation. The cavitation induced by the passage of ultrasonic waves is so-called acoustic cavitation, while cavitation due to the pressure variations in the flowing liquid is termed as hydrodynamic cavitation. Acoustic and hydrodynamic cavitation may result in the desired physical and chemical changes in a solution, but optic and particle cavitation are incapable of bringing about any change in the bulk solution.

Millions of hot spots in the reactor can be generated through hydrodynamic and acoustic cavitation due to very high localized energy density which in turn results in extremely high pressure and temperatures in the range of 10-500 MPa and 1000-10,000 K, respectively. However, it should be noted that the collapse of MBs in the absence of dynamic stimulus would not favour the creation of such hot spots.

Nowadays, few methods have been developed for the generation of MBS and NBs. The two widely used methods are based on decompression and gas-water circulation. For the decompression type generator, a supersaturated condition for gas dissolution is created at high pressure of 304-405 kPa. At such high pressure, supersaturated gas is highly unstable and eventually escapes out from the water. As the result, large number of MBs would be generated instantly. However, for gas-water circulation type generator, the gas is introduced into the water vortex, and gas bubbles are subsequently broken down into MBs by breaking up the vortex Similar to the decompression type, the venturi-type MB generator has also been widely used. This has the advantages of compact size, low pump power and high-density generation of MBs normally with a mean diameter below 100 Im. The venturi-type generator consists of three main parts, i.e. inflow, tubule and tapered outflow.

Cavitation occurs due to decrease in static pressure of the pressurized fluid entering the tubule part. In the tubule part, velocity of the fluid increases at the cost of decrease in static pressure. Simultaneously, gas entering into the tube part from outside develops a multiphase-flow of the gas and liquid. When the fluid exceeds the speed of sound, a pressure wall with a shock wave is created. MBs are thus generated through the collision of gas with the pressure wall developed with a shock wave.

Besides the use of decompression and gas-water circulation methods for the generation of MBs, a palladium electrode coupled with ultrasonication has been used for generation of NBs with a mean diameter of 300-500 nm. Moreover, it has been reported that NBs with a mean diameter of 400-700 nm could be created by ultrasonication of a mixed surfactant solution.

A number of MB and NB generators can be selected. This includes for example a Sarl-Ylec Generator—MBA for producing Microbubbles A—10-40 micron or a Carmin D1—MBA Generator. Different generators, such as the miniGaLF MB/NB generators, can be used to produce different ranges of the required MB or NB sizing. For example, a first Nano bubble Generator could be generating—NBC1 & C2—with Size distribution (100-300 nm). A second Nano bubble Generator—NBB—with centrifugal pump could be producing NB of 150-300 nm.

Figure 3:
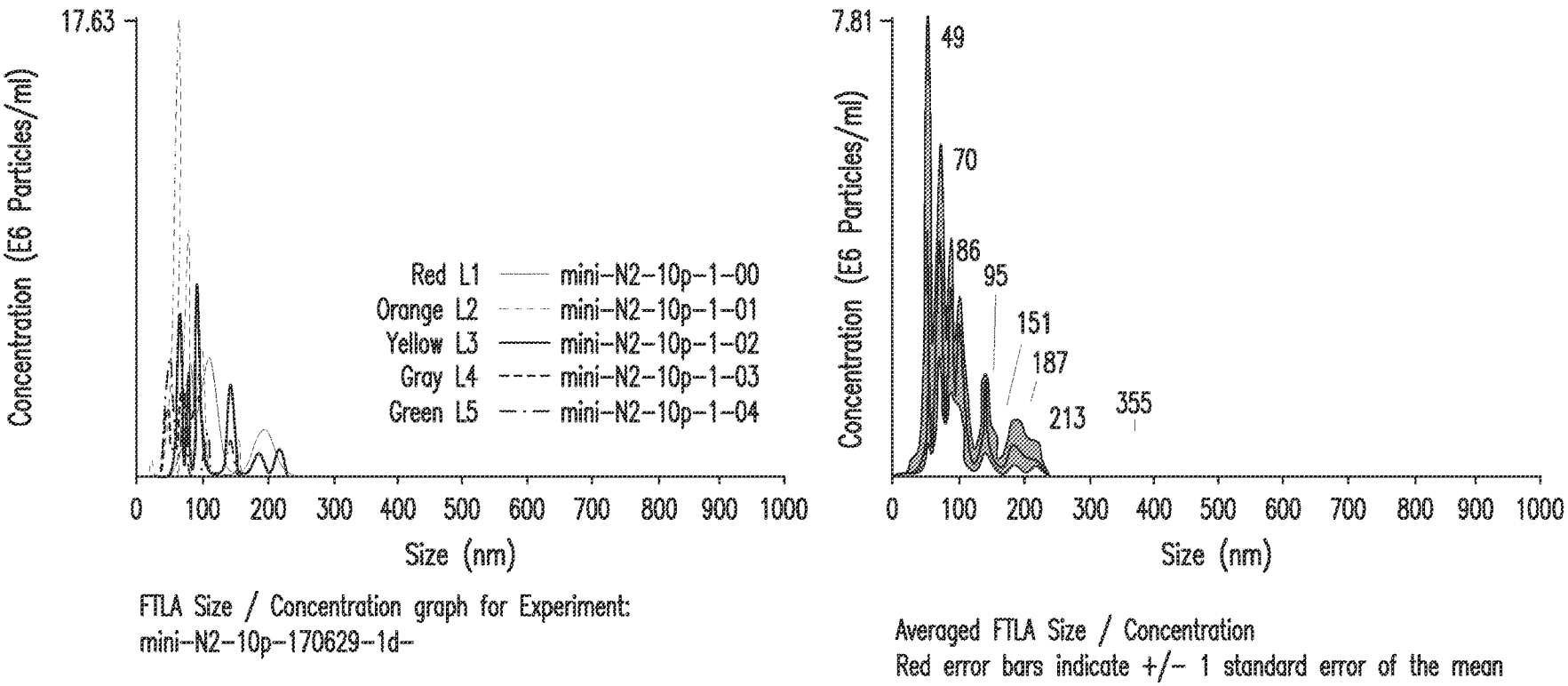

Referring to FIGS. 3 and 4 there is a graphical representation and technical sheet of output of size distribution and concentration data for NB Generated with miniGaLF (Japanese equipment make) The instrument, as shown by the NanoSight technical sheet, allows for reproducible NB characterisation and the standard average data. The diagrams show the typical averaged NB count/concentration and size distribution for their range of NB generators.

NB/MB can be produced in at least 10 different ways using different mechanical/physical principles.

Effect of Mixture of Two Different Ranges of Sizes of Nanobubbles or Nano Bubbles and Micro Bubbles Generally the aim is the actual use of NB and NB/MB (50/50 in the testing but not locked to that ratio) in the emulsion explosives with the cost benefit gain provided by improved stability for lower ROSA contents, replacement of chemical gassing and NB and improvement of the water ring to facilitate emulsion pumping. The ultimate, we hope is that the blasting performance will benefit from the introduction of the technology of NB in EE.

Gas is infused with two different ranges of sizes of nanobubbles. The primary benefit of NanoBubbles as observed in the experiments is the stabilising effect on water-based emulsions and water gels, which allows for an optimisation of formulations and therefore making them more cost-effective compared to the regular products using chemical gassing.

It was also found that NB or NB/MB blend contribute to improved emulsion stability allowing for cost efficient optimisation of PIBSA and other emulsifiers' contents.

NBs serve as density control and sensitivity agent and consequently providing an improved emulsion and blasting performance.

NBs and NB/MB admixture serve as a substitute for the gas bubbles provided by the current technology of chemical gassing and mechanical air admixture.

In this case about the actual properties includes:

a) Chemical gassing does destabilise the products and shortens the shelf-life considerably, b) The secondary aspect is the actual physical properties of NB where the NB inside pressure increases with the smaller size and that may contribute to a more efficient detonation process.

c) the detonation properties as the smaller size homogenous bubbles yield a more efficient detonation and therefore the overall blasting performance is also improved.

d) MicroBubbles or at least NanoBubbles of different range of size are very necessary and useful in order to achieve and control the product's final density. MBs takes up more volume space and that results in the required density control. Depending on their injected and controlled volumes the density can vary between 800 kg/cubic metre (or lower) to 1400 kg/cubic metre.

Density

The data collected includes measuring density changes on products containing more water in the formulation (>20 w %—insensitive enough to run safe lab experiments) and pumping a low viscosity emulsion (18-22 Kcps) through the generator at constant rate while letting the air feed going through at different flow rates. The emulsion got saturated in the Japanese make generator with the bubbles The density changes from 1.35-1.38 g/cc down to 1.18-1.22 g/cc have been obtained and the stored products after 3-4 weeks shelf storage at 15-22 deg C. (night-day temp in my lab) showed a slight density increase in range of 1.20-1.25 g/cc.

The next step like in any explosive's development work, is to shoot the products both fresh and after some storage. In order to do that, there needs to produce larger quantities of product in a pilot plant set up and test it in the field by shooting charges (dia 75 mm×1000 mm) and measure VOD (velocity of detonation) and assess some other characteristics.

The method of NB/MB generation for the purpose of sensitising and density control of explosives can have significance, either as the physical explosives characteristics or as part of a continuous process for the benefit of full automatization of the loading operations.

In addition the ratios and bubbles volumes of NB and MB are required in order to achieve the pre-determined final product density. In general, the product density needs to be lowered from 1.35-1.4 g/cc to the range of 0.8-1.25 g/cc by admixing the satisfactory amount of MB.

The adjustments can be done in a number of different ways:

i) via the carrier saturated with NB/MB ii) additional feed and in-line blending of depressurised air/gas Water Ring The Emulsion Explosives (EE) pumping technology uses a water ring technique to facilitate the transfers of viscous emulsion in an efficient way. Referring to FIG. 7 the Water Ring is an integral part of the borehole pumping/charging and therefore when NB/MB are introduced the whole operation becomes more cost effective and technologically advanced.

According to this invention the NB saturated water ring (with or without the surfactants lowering the surface tension of water or with/without dissolved ammonium nitrate/other nitrates) reduces substantially the resistance of pumping the viscous water-in-oil emulsion and that is due to the huge surface area created by NB Pumping of. Emulsion explosives at any pumping rate requires so called water ring around the "emulsion plug" being pushed/pumped through the charging hose. Without that water ring the pumping process would be very difficult due to the friction between the water-in-oil emulsion and any type of hose.

One way to improve it is to have that water ring/water flow in between. It has been observed in the lab that the NB saturated water allows the emulsion slide out of tubing/plastic containers much easier than with just plain water.

It is well proved in other industries that use of water ring saturated with NB/MB does greatly facilitate the pumping process for long distance/small diameter piping transfers.

Example Methods

TABLE 1

| 1 Ingredients | MB/NBGenerators/ Origin/Parameters | F001 | F002 | F003 | F004 | F005 | F006 | F007 | F008 | F009 | F010 | F011 |
|---|---|---|---|---|---|---|---|---|---|---|---|---|
| 2 parts by weight | | S&Ref | | | | | | | | | | Std&R |
| 3 Oxidiser Solution | | | | | | | | | | | | |
| 4 AN-ammonium nitrate | Crystalline | 80 | 80 | 80 | 80 | 80 | 80 | 80 | 80 | 80 | 80 | 83 |
| 5 Water | Tap water | 20 | 20 | 20 | 20 | 20 | 20 | 20 | 20 | 20 | 20 | 17 |
| 6 SN-Sodium nitrate | Techn grade | | | | | | | | | | | |
| 7 | | 100 | 100 | 100 | 100 | 100 | 100 | 100 | 100 | 100 | 100 | 100 |
| 8 Fuel Solution | | | | | | | | | | | | |
| 9 ArkomonXP1320 | Clariant Australia | 20 | | 20 | 20 | 15 | | 15 | 15 | 15 | 15 | 20 |
| 10 Lubrizol 28538A | Lubrizol Europe | | 20 | | | | 15 | | | | | |
| 11 Parrafin Wax | ARISTO143 | | | | | | | | | | | |
| 12 Microcrystalline Wax | WITCOX14 | | | | | | | | | | | |
| 13 Mineral Oil | Caltex Australia | | | | | | | | | | | |
| 14 SMO-Sorbitan Monooleate-SPAN80 | Croda Australia | | | | | | | | | | | |
| 15 ArkomonXP1320 | Clariant Australia | | | | | | | | | | | |
| 16 Diesel Fuel OilNo2 | Caltex | 80 | 80 | 80 | 80 | 85 | 85 | 85 | 85 | 85 | 85 | 80 |
| 17 | | 100 | 100 | 100 | 100 | 100 | 100 | 100 | 100 | 100 | 100 | 100 |
| 18 Matrix | | | | | | | | | | | | |
| 19 Oxidiser Solution | | 94 | 94 | 94 | 94 | 94 | 94 | 94 | 94 | 94 | 94 | 94 |
| 20 Fuel Solution | | 6 | 6 | 6 | 6 | 6 | 6 | 6 | 6 | 6 | 6 | 6 |
| 21 Gassing agent | Sodium nitrite | | | | | | | | | | | |
| 22 | | 100 | 100 | 100 | 100 | 100 | 100 | 100 | 100 | 100 | 100 | 100 |
| 23 Matrix at ambient/ 20-25 degC. | Admixture Type: no NB/1% waterNB/MB/ 1% watMB | Matrix no NB | Matrix 1% water no NB | Matrix 1% water MBA | Mat 1% water NBC1 | Matrix no NB | Mat 1% wat no NB | Mat 1% water MBA | Mat 1% water NBB | Mat 1% water NBC1 | Matrix 1% wat NBC2 | Matrix 83% AN sol No NB |
| 24 | | Std&R | Std&R | | | Lower Emuls cont | Lower Emuls cont | Lower Emuls cont | Lower Emuls cont | Lower Emuls cont | Lower Emuls cont | Std&R |
| 25 Microbubbles A-MBA (10-40 microm) | Sarl-Ylec Generator | 0 | | Yes | 0 | 0 | | Yes | 0 | 0 | 0 | |
| 26 | Cavitation principle | | | | | | | | | | | |
| 27 | 6 Bar water feed | | | | | | | | | | | |
| 28 | 0-3 Bar gas feed | | | | | | | | | | | |
| 29 NB B-(150-200 nm) | Centrifugal pump& | 0 | | 0 | 0 | 0 | | 0 | Yes | 0 | 0 | 0 |
| 30 | Needle restriction | | | | | | | | | | | |
| 31 | Hydrodynamic cavitation 3-5bar water feed with atmospheric air or CO 2; STT-Surfex Technology in-house set up | | | | | | | | | | | |
| 32 NB C1-(50-100 nm) mean 100 nm | Nanobubble generator-Japanese make | 0 | | 0 | Yes | 0 | | 0 | 0 | Yes | 0 | 0 |
| 33 | Static mixer principle (liquid-gas) | | | | | | | | | | | |
| 34 | (2 water passes-generates smaller NB & more concentrated solution) | | | | | | | | | | | |
| 35 NB C2-100-700 nm-mean 300 nm | Nanobubble generator-Japanese make-Static mixer principle (liquid-gas)-1 water pass | 0 | | 0 | 0 | 0 | | 0 | 0 | 0 | Yes | 0 |
| 36 Capacitance pF/20 degC. fresh made | | 180 | 210 | 195 | 135 | 365 | 380 | 390 | 340 | 235 | 310 | 180 |
| 37 Degree of Crystallisation | Shelf life/ stability 20 degC. | | | | | | | | | | | |
| 38 1. week | | None | None | None | None | Slight Mod | Slight Mod | None None | None None | None | None | None None |
| 39 3 weeks | | | | | | | | | | | | |

TABLE 1-continued

| 1 | Ingredients | MB/NBGenerators/ Origin/Parameters | F001 | F002 | F003 | F004 | F005 | F006 | F007 | F008 | F009 | F010 | F011 |
|---|---|---|---|---|---|---|---|---|---|---|---|---|---|
| 40 | 6 weeks | | | | | | | | Light | None | | | Mod |
| 41 | 12 weeks | | None | None | None | None | | | | | None | None | |
| 42 | 20 weeks | | | | | None | | | | None | None | None | |
| 43 | 30 weeks | | None | None | None | | | | | | | | |

Example F004 (Bulk—Booster Sensitive Formulation—500 g Batch)

A mixture of technical grade AN (80 w %), and water (20 w %) was heated with stirring to a temperature of about 70 deg C. to give an aqueous solution. The solution was then poured, with rapid stirring using conventional cake mixer and after pH adjustment, into a hot solution (65 degrees Celsius) of 20 parts of PIBSA based emulsifier Arkomon XP1320 mixed with 80 parts of No2 fuel oil.

Stirring was continued until a uniform emulsion matrix was obtained. The parts ratio between the oxidiser solution and the fuel was kept at 94:6 which translates to the following composition in 500 g batch size: AN=376 g/Water=94 g/DFO=24 g/PIBSA=6 g The matrix sample was then taken for shelf-life observations, capacitance measurement and evaluation with admixture of NBC1 (see Table 1) generated in the commercial NB generator based on the static mixer/liquid-gas principle designed to produce 40-100 nm air bubbles after 2 water passes through the generator. The unit is a self-contained generator of Japanese make (NB1, Misumi).

0.4 w % of the NBC1 bubbles was mixed thoroughly into ambient temperature matrix and left for long time observations.

Other Bulk—Booster Sensitive Formulations:

the procedure of example F004 of making the emulsion matrix was repeated for all the other formulations with details provided in Table 1 and the details discussed under the RESULTS heading.

Booster sensitive Formulation F017 and F018 are different with regards to generation of NB in DFO respectively in Mineral oil instead of NB formation in water.

Booster sensitive formulations F005-6-7-8-9-F010 had reduced content of PIBSA to 10 parts and the effects of NB on matrixes' stability/crystallisation was studied as a function of storage time.

Booster sensitive formulation F019 used alfa-Terpineol as water surface reducer added to the NBC1 saturated water and F020 formulation used a 50/50 w % ratio for NBC1/MBA admixture.

Booster sensitive formulation F021 evaluated stability of a gassed emulsion.

TABLE 2

| 1 | Ingredients | MB/NB Generators/ Origin/Parameters | F012 | F013 | F014 | F015 | F016 | F017 | F018 | F019 | F020 | F021 |
|---|---|---|---|---|---|---|---|---|---|---|---|---|
| 2 | parts by weight | | | Std&R | | | | | | | | |
| 3 | Oxidiser Solution | | | | | | | | | | | |
| 4 | AN-ammonium nitrate | Crystalline | 83 | 78 | 78 | 80 | 80 | 80 | 80 | 80 | 80 | 80 |
| 5 | Water | Tap water | 17 | 11 | 11 | 20 | 20 | 20 | 20 | 20 | 20 | 20 |
| 6 | SN-Sodium nitrate | Techn grade | | 11 | 11 | | | | | | | |
| 7 | | | 100 | 100 | 100 | 100 | 100 | 100 | 100 | 100 | 100 | 100 |
| 8 | Fuel Solution | | | | | | | | | | | |
| 9 | ArkomonXP1320 | Clariant Australia | 20 | | | | | 20 | 20 | 15 | 15 | 20 |
| 10 | Lubrizol 28538A | Lubrizol Europe | | | | | | | | | | |
| 11 | Parrafin Wax | ARISTO143 | | 15 | 15 | | | | | | | |
| 12 | Microcrystalline Wax | WITCOX14 | | 15 | 15 | | | | | | | |
| 13 | Mineral Oil | Caltex Australia | | 50 | 50 | | | | 80 | | 85 | 80 |
| 14 | SMO-Sorbitan Monooleate-SPAN80 | Croda Australia | | 17 | 17 | 30 | 30 | | | | | |
| 15 | ArkomonXP1320 | Clariant Australia | | 3 | 3 | | | | | | | |
| 16 | Diesel Fuel Oil No2 | Caltex | 80 | | | 70 | 70 | 80 | | 85 | | |
| 17 | | | 100 | 100 | 100 | 100 | 100 | 100 | 100 | 100 | 100 | 100 |
| 18 | Matrix | | | | | | | | | | | |
| 19 | Oxidiser Solution | | 94 | 95 | 95 | 94 | 94 | 94 | 94 | 94 | 94 | 94 |
| 20 | Fuel Solution | | 6 | 5 | 5 | 6 | 6 | 6 | 6 | 6 | 6 | 6 |
| 21 | Gassing agent | Sodium nitrite | | | | | | | | | | Yes |
| 22 | | | 100 | 100 | 100 | 100 | 100 | 100 | 100 | 100 | 100 | 100 |
| 23 | Matrix at ambient/ 20-25 degC. | Admixture Type: no NB/1% water NB/MB/1% watMB | Matrix 83% AN sol 1% water NBC1 | Matrix no NB | Mat 1% water NBC1 | Matrix no NB | Matrix 1% water NBC1 | Matrix 1% DFO NBC1 | Mat 1% MO NBC1 | Matrix 1% water alfa-Terpineol NBC1 | Matrix 1% 50MBA/ 50NBC1 | Mat 1% Gassin Sol |
| 24 | | | | Std&R | | | | | | | Lwr Emul cont | |

TABLE 2-continued

| 1 | Ingredients | MB/NB Generators/ Origin/Parameters | F012 | F013 | F014 | F015 | F016 | F017 | F018 | F019 | F020 | F021 |
|---|---|---|---|---|---|---|---|---|---|---|---|---|
| 25 | Microbubbles A-MBA (10-40 microm) | Sarl-Ylec Generator | 0 | 0 | | | | | | | Yes | 0 |
| 26 | | Cavitation principle | | | | | | | | | | |
| 27 | | 6 Bar water feed | | | | | | | | | | |
| 28 | | 0-3 Bar gas feed | | | | | | | | | | |
| 29 | NB B-(150-200 nm) | Centrifugal pump& | 0 | 0 | 0 | 0 | 0 | 0 | 0 | | 0 | 0 |
| 30 | | Needle restriction | | | | | | | | | | |
| 31 | | Hydrodynamic cavitation 3-5bar water feed with atmospheric air or CO 2; STT-Surfex Technology in-house set up | | | | | | | | | | |
| 32 | NB C1-(40-100 nm) mean 100 nm | Nanobubble generator-Japanese make | Yes | 0 | Yes | 0 | Yes | Yes | Yes | | Yes | 0 |
| 33 | | Static mixer principle (liquid-gas) | | | | | | | | | | |
| 34 | | (2 water passes-generates smaller NB & more concentrated solution) | | | | | | | | | | |
| 35 | NB C2-100-700 nm-mean 300 nm | Nanobubble generator-Japanese make-Static mixer principle (liquid-gas)-1 water pass | 0 | 0 | 0 | | 0 | 0 | 0 | | 0 | 0 |
| 36 | Capacitance pF/20 degC. fresh made | | 190 | 120 | 110 | 240 | 265 | 145 | 160 | 220 | 240 | 195 |
| 37 | Degree of Crystallisation | Shelf life/ stability 20 degC. | | | | | | | | | | |
| 38 | 1. week | | None | None | None | None | None | None | None | None | None | None |
| 39 | 3 weeks | | | None | None | Mod | None | None | None | None | None | Light |
| 40 | 6 weeks | | | | None | | None | | | | None | Light |
| 41 | 12 weeks | | None | Mod | None | | Mod | | None | | | Mod |
| 42 | 20 weeks | | | | | | | None | | None | None | |
| 43 | 30 weeks | | | | None | | | | None | | | |

Example F014 (Cap-Sensitive Formulation-500 g Batch)

A mixture of technical grade AN (78 w %), sodium nitrate (11 w %) and water (11 w %) Was heated with stirring to a temperature of about 90 deg C. to give an aqueous solution. The hot salt solution was then poured, with rapid stirring, into a hot solution (85 degrees Celsius) of 15 w % of microcrystalline, 15 w % of paraffin wax, 50 w % of mineral oil and 17 w % of SMO with 3 w % of PIBSA.

Stirring was continued until a uniform emulsion was obtained.

The parts ratio between the oxidiser solution and the fuel was kept at 95:5 w % which translates to the following composition in 500 g batch size:

AN=370.5 g/SN=52.25 g/water=52.25 g/waxes=7.5 g/M0=12.5/SMO=4.25 g/PI BSA=0.75 g=500 g The matrix sample was treated in the same way as in an example of formulation F004 and NBC1 bubbles were injected and stirred in at ambient temperature for further observations

Example F022-F027 (Water Gel Formulations)

F023

A mixture of technical grade AN (70 w %) and water (13 W %) was heated to 75 degrees Celsius (Solution 1). Separately, Nitric acid was reacted with Hexamine (Solution 2).

Both solutions 1 and 2 were mixed together and with added Guar gum thickener formed a gel. That gel was the matrix to be mixed with ANFO (94 w % AN/6 w % DFO) and with NB C1—Nano bubbles.

F024

70 w % of F023 gel was mixed with 30 w % ANFO and followed by addition of NBC1 and crosslinked with chromic acid/aluminium sulphate crosslinking solution.

The standard reference sample F022 with no NB was observed for any liquid separation and crystallisation at ambient storage and compared with a similar formulation F024 containing NBC1 bubbles.

F026

A mixture of technical grade AN (71 w %), water (5 w %) and 20 w % of MMAN (monomethyl amine nitrate—80% strength) was heated to 75 deg C. (Solution 1).

Sodium perchlorate (3 w %) was added to Solution 1 and with added Guar gum (1 w %) formed a gel. That gel was the matrix to be mixed with ANFO and with NBC1—Nano bubbles.

F027

70 w % of F026 gel was mixed with 30 w % of ANFO and followed by addition of 1 w % of NBC1 and crosslinked thereafter.

Standard reference sample F025 with no NB was observed for liquid separation and signs of crystallisation at ambient storage and compared with similar formulation F027 containing NB C1 bubbles.

Results

1. Bulk Emulsion (Booster Sensitive)

Shelf life observations with a number of past weeks showed that the stability of emulsions based on a lower PIBSA-based emulsifier content (15 w % of fuel solution) improved with admixture of NBs generated both with the centrifugal generator (NBB) and static mixer type generator (NBC1 and NBC2)—F008/F009/F010.

F005 and F006 were emulsion batches used as the reference with that lower PIBSA content (15 w %) and no MB/NB were added. Both batches started crystallising after 1 week of storage.

Batches F001 & F002 with higher PIBSA content (20 w % in fuel solution) and used as standard references did show a comparable storage stability when MB (F003) or NB (F004) were used.

F011 and F012 were emulsions made on a higher AN concentration (83 w %) and a higher PIBSA content (20% in fuel solution). F012 batch containing NBC1 showed an increased stability compared to the reference batch without any NB.

F015 and F016 were batches based on fuel solution containing SMO and DFO No2. Batch F016 with NBC1 showed a better shelf-life when compared to the reference F015 which did not contain any NB.

Batch F018 containing NBC1 and based on Mineral oil and 20 w % of PIBSA in fuel solution showed better shelf life compared to the batch F017 (also 20 w % of PIBSA in fuel solution) with NBC1 but based on DFONo2.

Batches F017 and F018 in difference to all other made formulations (infused with MB/NB in a saturated water solution) were infused with NBC1 generated in 1 w % of DFONo2 (F017) and in mineral oil (F018).

Both batches showed good stability and compared favourably with the samples (F004) infused with NBC1 generated in water.

Both DFO and mineral oil based NBC1 saturated solutions were easier to blend into emulsion matrix compared to the water based NBC1 saturated solutions.

This interesting aspect of the invention may have beneficial practical application as an alternative of a miscible/hydrophobic NB carrier and its infusion into the external phase of water-in-oil emulsion.

There was a noticeable difference in the stability of the non-gassed (F004) emulsion containing NBC1 when compared to the chemically gassed F021 which started showing light crystallisation on the 3$^{rd}$ week of storage whereas the non-gassed, NBC1 saturated batch was stable for over 20 weeks.

Sample F019 with a lower PIBSA content (15 w % in fuel solution) containing water saturated NBC1 and alfa-Terpineol (surfactant used to reduce water's surface tension and allowing to produce a higher concentration of NB in water solution) showed comparable shelf-life to the batches based on 15 w % PIBSA and DFONo2 with NBB & NBC1 & NBC2 were used (F008-F009-F010).

Batch F020 with a lower PIBSA content (15 w % in fuel solution) and mineral oil when mixed with 1 w % of a blend at ca 50 MBA/50 NB C1 showed a better shelf-life when compared to the batch based on DFONo2 (F007) or batch F021 with 20 w % PIBSA (in fuel solution) but chemically gassed.

Formulations (20% PIBSA in fuel solution) with NB produced with NB generator (2 passes) showed improved stability at ambient storage and at hot/cold temperature cycling compared to the reference samples without NB Formulations (10% PIBSA in fuel solution) are less stable compared to formulations containing 20% PIBSA in fuel solution Formulation (10% PIBSA in fuel solution) containing NB showed better overall stability on storage at ambient temperature as well as when cycled at hot and cold temperatures compared to the similar PIBSA content formulation without NB 2. Cap—Sensitive Emulsions The reference batch F013 without any NB was less stable compared to the batch F014 containing NBC1.

Formulations containing NB show better stability than the formulations without NB 3. Water Gel Formulations Testing results for 2 different formulations, one sensitised with Hexamine nitrate ((F023) and the other (F026) sensitised with MMAN shown improved long-term storage stability when combined with Nano bubbles produced at average sizes of 100 nm.

Capacitance Measurements—Emulsions

Capacitance values show to be lower for formulations containing NB which indicates improved stability for the NB containing formulations

TABLE 3

| 1 Ingredients | NB Generators/ Origin/Parameters | F022 | F023 | F024 | F025 | F026 | F027 |
|---|---|---|---|---|---|---|---|
| 2 parts by weight | | S&Ref | Matrix | | S&Ref | Matrix | |
| 3 | | | | | | | |
| 4 Gel Solution Matrix | | | | | | | |
| 5 AN-ammonium nitrate | Crystalline | | 70 | | | 71 | |
| 6 Water | Tap water | | 13 | | | 5 | |
| 7 Potassium perchlorate | Redox | | 2 | | | | |
| 8 Hexamine | Redox | | 10 | | | | |
| 9 Nitric acid (as 100%) | Redox | | 4 | | | | |
| 10 Mono methylamine nitrate (80%) | Redox | | | | | 20 | |
| 11 Sodium Perchlorate | Redox | | | | | 3 | |
| 12 Guar Gum | | | 1 | | | 1 | |

TABLE 3-continued

| 1 | Ingredients | NB Generators/ Origin/Parameters | F022 | F023 | F024 | F025 | F026 | F027 |
|---|---|---|---|---|---|---|---|---|
| 13 | ANFO (94ANPrill/6DFO) | DFO-Diesel Fuel Oil-Caltex | 30 | | 30 | 30 | | 30 |
| 14 | Gel sol matrix F023 | | 70 | | 70 | 0 | | 0 |
| 15 | Gel sol matrix F026 | | 0 | | 0 | 70 | | 70 |
| 16 | | | 100 | 100 | 100 | 100 | 100 | 100 |
| 17 | X-linker (0.1 w %) | Chromic Acid/ Aluminum Sulphate | Yes | Yes | Yes | Yes | Yes | Yes |
| 18 | Matrix at ambient/ 20-25 degC. | Admixture Type: no NB/1% water NB | no NB | | w NB | no NB | | w NB |
| 19 | | | | | | | | |
| 20 | NB C1-(40-100 nm) mean 100 nm | Nanobubble generator-Japanese make | | | | | | |
| 21 | | Static mixer principle (liquid-gas) | | | | | | |
| 22 | | (2 water passes-generates smaller NB & more concentrated solution) | | | Yes | | | Yes |
| 23 | | | | | | | | |
| 24 | Degree of Crystallisation & Separation | Shelf life/stability 20 degC. | | | | | | |
| 25 | 1. week | | None | | None | None | | None |
| 26 | 3 weeks | | | | | | | |
| 27 | 6 weeks | | Light Sep | | | Light | | |
| 28 | 12 weeks | | Light Sep & crys | | None | Light Sep & Crys | | None |

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly, it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the explosives industries.

SUMMARY OF ABBREVIATIONS

AN (ammonium nitrate)
ANFO (94 w % AN+6 w % FO)
CARMEN (Carmen D1 MBA Generator)
DFO (Diesel Fuel Oil)
DFO No 2 (Diesel technical grade of fuel oil No2)
EE (Emulsion Explosives)
MB (Microbubbles) MB=(1-1000 microns)
MMAN (monomethyl amine nitrate)
MO (mineral oil)
NB (Nanobubbles) NB=(50-1000 nm)
NBB (centrifugal generator)
NBC1 and NBC2 (static mixer type generators)
NH4+(ammonium ion)
MB (Microbubbles)
MBA (Microbubbles A)
PIBSA (Poly-Iso-Butylene Succinic Anhydride)
SMO (Sorbitan Mono Oleate)
STT prototype (Surfex Technology & Trading)

The invention claimed is:

1. A method of manufacturing a water-based explosive comprising infusing a water-based explosive composition with gas supplied in at least part to the water-based explosive composition in the form of nanobubbles (NB) wherein the gas is infused with two different ranges of sizes of nanobubbles and wherein the gas is a combination of one or more of:

a. air;
b. oxygen;
c. $CO_2$;
d. nitrogen; and
e. hydrogen.

2. The method of manufacturing the water-based explosive according to claim 1 wherein the water-based explosive is a water-based gel explosive.

3. The method of manufacturing the water-based explosive according to claim 1 wherein the water-based explosive is a water-in-oil emulsion explosive.

4. The method of manufacturing the water-based explosive according to claim 3 wherein the water-in-oil emulsion explosive contains PIBSA (Poly-Iso-Butylene Succinic Anhydride).

5. The method of manufacturing the water-based explosive according to 32 wherein a first range of sizes of nanobubble is 50-100 nm and a second range of sizes of nanobubble is 100-700 nm.

6. The method of manufacturing the water-based explosive according to claim 3 wherein the gas is infused to the water-based explosive composition in the form of nanobubbles (NB) and microbubbles (MB) at a predefined ratio.

7. The method of manufacturing the water-based explosive according to claim 6 wherein the predefined ratio of nanobubbles (NB) and microbubbles (MB) is dictated by the NB generator used but with a higher ratio of NB.

8. The method of manufacturing the water-based explosive according to claim 3 wherein the nanobubbles NB were introduced to the emulsion Matrix as a highly saturated and concentrated nanobubbles NB or nanobubbles/microbubbles NB/MB in water solution.

9. The method of manufacturing the water-based explosive according to claim 8 wherein the nanobubbles NB were introduced to the emulsion Matrix as a highly saturated and concentrated NB in mineral oil/DFO carrier.

10. The method of preparing the water-based explosive according to claim 3 wherein the emulsion phase (matrix) of explosive contains PIBSA (Poly-Iso-Butylene Succinic Anhydride).

11. The method of preparing the water-based explosive according to claim 1 wherein a further step monitors the required explosive and stops or alters the providing of nano and micro bubbles.

12. The method of preparing the water-based explosive according to claim 1 wherein a further step monitors the required explosive and stops or alters the injecting the gas bubbles into the emulsion phase.

* * * * *